US006472955B2

(12) United States Patent
Saito et al.

(10) Patent No.: US 6,472,955 B2
(45) Date of Patent: Oct. 29, 2002

(54) DIELECTRIC RESONATOR, FILTER, DUPLEXER, AND COMMUNICATION DEVICE

(75) Inventors: Kenji Saito, Kanazawa; Hiroyuki Kubo, Kusatsu; Hiroki Wakamatsu, Kyoto, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/819,543

(22) Filed: Mar. 28, 2001

(65) Prior Publication Data

US 2001/0043132 A1 Nov. 22, 2001

(30) Foreign Application Priority Data

Mar. 30, 2000 (JP) ..... 2000-093695
Feb. 5, 2001 (JP) ..... 2001-028203

(51) Int. Cl.[7] ..... H01P 1/213; H01P 7/10
(52) U.S. Cl. ..... 333/134; 333/202; 333/219.1
(58) Field of Search ..... 333/219.1, 202, 333/134, 206

(56) References Cited

U.S. PATENT DOCUMENTS 4,839,773 A * 6/1989 Ishikawa et al. ..... 361/321
5,874,870 A * 2/1999 Nishiyama et al. ..... 333/202
5,898,349 A * 4/1999 Hattori et al. ..... 333/202

* cited by examiner

*Primary Examiner*—Robert Pascal
*Assistant Examiner*—Dean Takaoka
(74) *Attorney, Agent, or Firm*—Ostrolenk, Faber, Gerb & Soffen, LLP

(57) ABSTRACT

A dielectric resonator includes a cavity member formed of an electrically conductive material and a dielectric core disposed in the cavity member. The resistance against heat cycle fatigue in bonding portions between the dielectric core and the cavity member is enhanced without causing increases in material cost and production cost. An electrode is formed on each end face of the dielectric case, or on the end face of each flange portion of the dielectric core. A metal foil having a cover portion for covering each end face, and having a spring portion which may be bent along the outer edge of the flange portion is connected to the dielectric core by bonding the cover portion of the metal foil to the end face using an electrically conductive adhesive. Thereafter, the spring portion of the metal foil is soldered to the inner surface of the cavity wall. The metal foil has a portion raised toward the inner surface of the cavity wall, and the inside of the raised portion is filled with an adhesive. A filter, a duplexer, and an communication device are also formed using the above-described dielectric resonator.

12 Claims, 15 Drawing Sheets

FIG. 7A
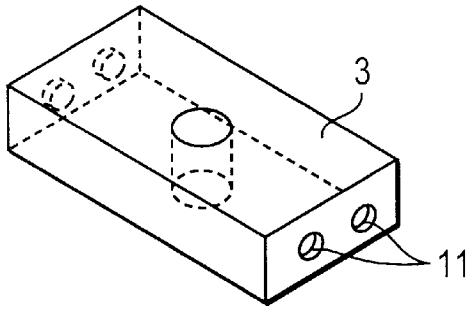
FIG. 7B
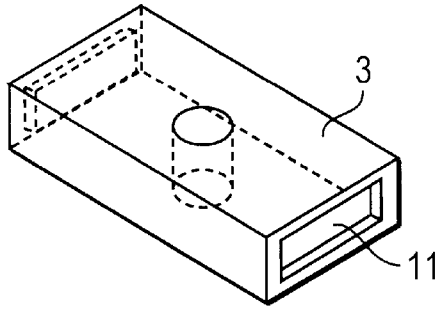
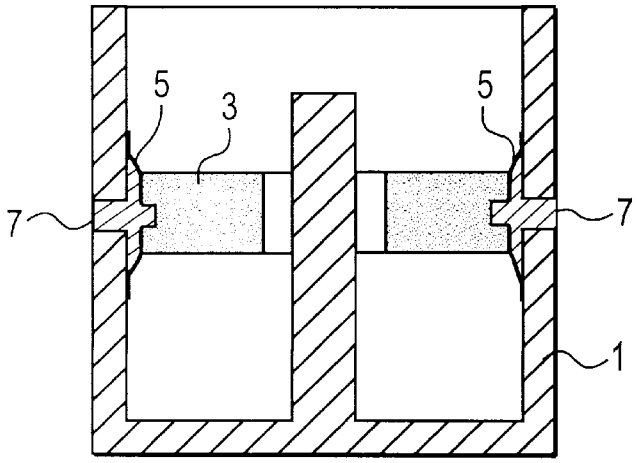
FIG. 8

DIELECTRIC RESONATOR, FILTER, DUPLEXER, AND COMMUNICATION DEVICE

BACKGROUND OF THE INVENTION

1. Field of the Invention

The present invention relates to a dielectric resonator including a dielectric core and a cavity. The present invention also relates to a filter and a duplexer using such a dielectric resonator and to a communication device including such a filter or a duplexer.

2. Description of the Related Art

Conventionally, a small-sized dielectric resonator including a dielectric core disposed in a cavity is capable of handling relatively high power in a microwave range.

For example, a dielectric resonator using a TM mode is formed by disposing a dielectric core of dielectric ceramic in a cavity of a cavity member formed of metal or ceramic the surface of which is covered with an electrode film.

An example of a structure of a conventional dielectric resonator is shown in FIGS. 18, 19A, and 19B, wherein FIG. 18 is an exploded perspective view, FIG. 19A is a top view, and FIG. 19B is a cross-sectional view. In this example, the dielectric resonator is formed as follows. A dielectric core 3 having electrodes formed on two respective end faces thereof is inserted into a main portion 1 of a cavity member made of metal, and the two end faces of the dielectric core 3 are connected to the inner surface of the main portion 1 of the cavity member via solder 6 (see FIG. 19A–19B). Thereafter, the opening of the main portion 1 of the cavity member is closed with a cavity lid 2.

In the above structure in which both end faces of the dielectric core are bonded to the inner surface of the cavity member, if there is a large difference between the coefficient of linear expansion of the dielectric core and that of the cavity member, degradation occurs in the bonding portion between the dielectric core and the cavity member due to heat cycle fatigue, and thus sufficiently high reliability cannot be obtained.

One known technique to avoid the above problem is to form a dielectric core and a cavity member by means of a monolithic molding process. In this structure, because both the dielectric core and the cavity member are formed of the same ceramic material, there is essentially no problem due to the heat cycle fatigue.

However, this structure, formed by monolithically molding the dielectric core and the cavity member, is formed of dielectric ceramic, despite the fact that most of the cavity member does not need to be dielectric. Thus, the material cost increases. Besides, a complicated mold is needed and thus the production cost also increases.

Japanese Patent Application No. 11-283037 filed by the present applicant discloses a resonator formed by disposing a conducting bar together with a dielectric core into a cavity so that both a resonance mode associated with the dielectric core and a coaxial (semicoaxial) resonance mode are used. However, in this structure, there is a large difference between the linear expansion coefficient of the cavity member made of an ordinary metal material such as aluminum and that of the dielectric core, and thus sufficiently high reliability in the bonding portion between the dielectric core and the cavity member is not achieved for the above-described reason. The above problem can be solved if a metal material having a linear expansion coefficient similar to that of the dielectric ceramic material forming the dielectric core is employed to form the cavity member. However, the result is increased material cost for the cavity member and increased production cost needed to produce the cavity member.

Thus, there is a need for a dielectric resonator which has high durability against heat cycle fatigue in a bonding portion between an electrically conductive cavity member and a dielectric core disposed in the cavity member, and which can be produced without increasing the material cost and the production cost. There is also a need for a filter and a duplexer using such a dielectric resonator. There is further a need for a communication device including such a filter or a duplexer.

SUMMARY OF THE INVENTION

According to an aspect of the present invention, there is provided a dielectric resonator comprising: a dielectric core having an electrode formed on an end face thereof; an electrically conductive cavity member; and an electrically conductive foil having a bonding surface bonded to the end face and also having a bent spring portion, the bonding surface of the foil being adhesively bonded to the end face of the dielectric core via an electrically conductive adhesive, the spring portion of the foil being adhesively bonded to the inner surface of the cavity member via an electrically conductive adhesive.

In this dielectric resonator according to the present invention, the dielectric core preferably includes a flange portion formed on an end thereof, and the electrically conductive foil preferably includes a cover portion for covering an end face of the flange portion, and the spring portion of the electrically conductive foil is preferably formed by bending the cover portion along the edge of the flange portion.

According to another aspect of the present invention, there is provided a dielectric resonator comprising a dielectric core having an electrode formed on a particular end face thereof; an electrically conductive cavity member; and an electrically conductive foil, a central portion of which is raised to one side, the raised portion of the foil being adhesively bonded to the end face of the dielectric core via an electrically conductive adhesive, the spring portion of the foil being adhesively bonded to the inner surface of the cavity member via an electrically conductive adhesive.

In these structures described above, the end face of the dielectric core is elastically connected to the inner surface of the cavity member via the electrically conductive foil instead of being directly connected. As a result, distortion due to the difference between the linear expansion coefficient of the dielectric core and that of the cavity member is absorbed by the foil having elasticity, and thus no heat cycle fatigue occurs in the bonding portion between the dielectric core and the cavity member.

In this dielectric resonator according to the present invention, an adhesive is preferably inserted into the space surrounded by the raised portion so that electrical connection between the end face of the dielectric core and the cavity member is achieved via the electrically conductive foil, and mechanical connection between them is achieved via the foil and the adhesive. Because the end face electrode of the dielectric core and the cavity member are electrically connected to each other via the electrically conductive foil, no electric field enters the adhesive, and thus no degradation occurs.

In this dielectric resonator according to the present invention, preferably, the cavity member has a hole leading to the space surrounded by the raised portion, and the hole and the space surrounded by the raised portion are filled with an adhesive. This makes it possible to easily inject the adhesive from the outside of the cavity member. Furthermore, the cured adhesive is fitted in the hole and thus the bonding strength between the cavity member and the foil and the dielectric core is enhanced.

In this dielectric resonator according to the present invention, preferably, the dielectric core has a recessed and protruded portion formed on an end face thereof. This results in an increase in the bonding strength between the end face of the dielectric core and the adhesive in a shearing direction.

According to still another aspect of the present invention, there is provided a filter including a dielectric resonator having one of the structures described above; and a coupling structure which is coupled with an electromagnetic field in the resonance mode of the dielectric resonator and which serves as an signal input/output part.

According to still another aspect of the present invention, there is provided a duplexer including a filter formed of a plurality of dielectric resonators having one of the structures described above; and a coupling structure which is coupled with two of the plurality of dielectric resonators so that the coupling structure serves as a common antenna input/output terminal.

According to still another aspect of the present invention, there is provided a communication device including the filter or the duplexer described above.

Other features and advantages of the present invention will become apparent from the following description of embodiments of the invention which refers to the accompanying drawings, in which like references denote like elements and parts.

BRIEF DESCRIPTION OF THE DRAWING(S)

FIGS. 7A–7B are perspective views of a dielectric core used in a dielectric resonator according to a third embodiment of the present invention;

FIG. 8 is a cross-sectional view of the dielectric resonator shown in FIG. 7;

DETAILED DESCRIPTION OF EMBODIMENTS OF THE INVENTION

Figure 1A:
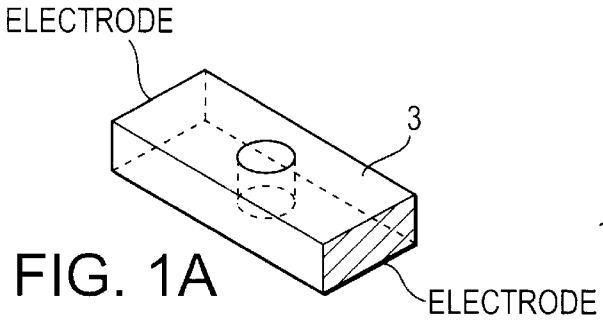
FIGS. 1A–1C are is a perspective views illustrating component parts of a dielectric resonator according to a first embodiment of the present invention.
Figure 1B:
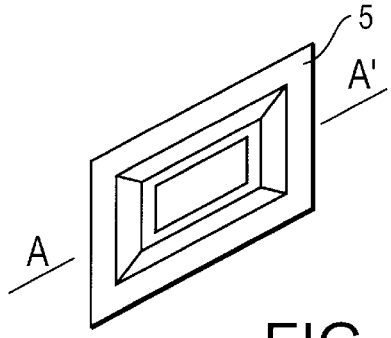
Figure 1D:
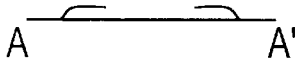
FIG. 1D is a cross-sectional view taken on line A–A'of FIG. 1B.
Figure 1C:
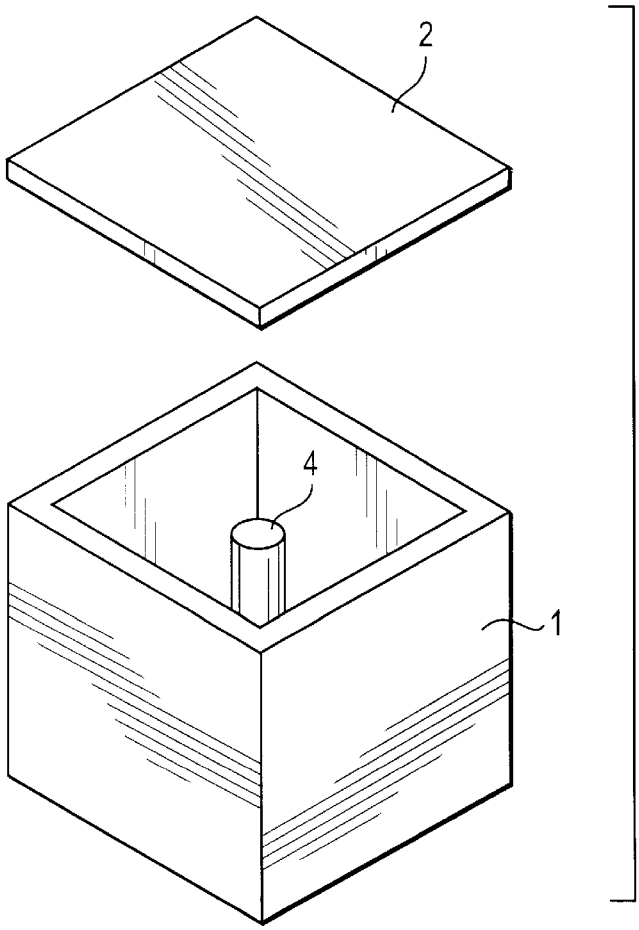

The structure of a dielectric resonator according to a first embodiment of the present invention is described below with reference to FIGS. 1A to 5. FIGS. 1A–1C are perspective views illustrating component parts of the dielectric resonator. FIG. 1A illustrates a dielectric core 3 formed of dielectric ceramic and having the external shape of a rectangular parallelepiped. A circular hole is formed in the center of the dielectric core 3, and a silver electrode film is formed on both end faces of the dielectric core 3.

FIG. 1B illustrates a metal foil 5 comprising a material such as a Cu foil or a Cu foil plated with Ag. A central portion of the metal foil 5 is raised to one side such that the raised portion substantially forms a plane and the peripheral portion substantially forms another plane. FIG. 1D is a cross-sectional view taken along line other than the peripheral portion. The central portion is not necessarily located at the exact center.

FIG. 1C illustrates a cavity member formed of metal such as aluminum plated with Ag. The cavity member includes a main portion 1 and a cavity lid 2. A conducting bar 4 is disposed in the main portion 1 of the cavity member such that the conducting bar 4 extends from the center of the bottom surface of the main unit 1. The conducting bar 4 may be formed separately from the main unit 1 or integrally with the main unit 1.

Figure 2:
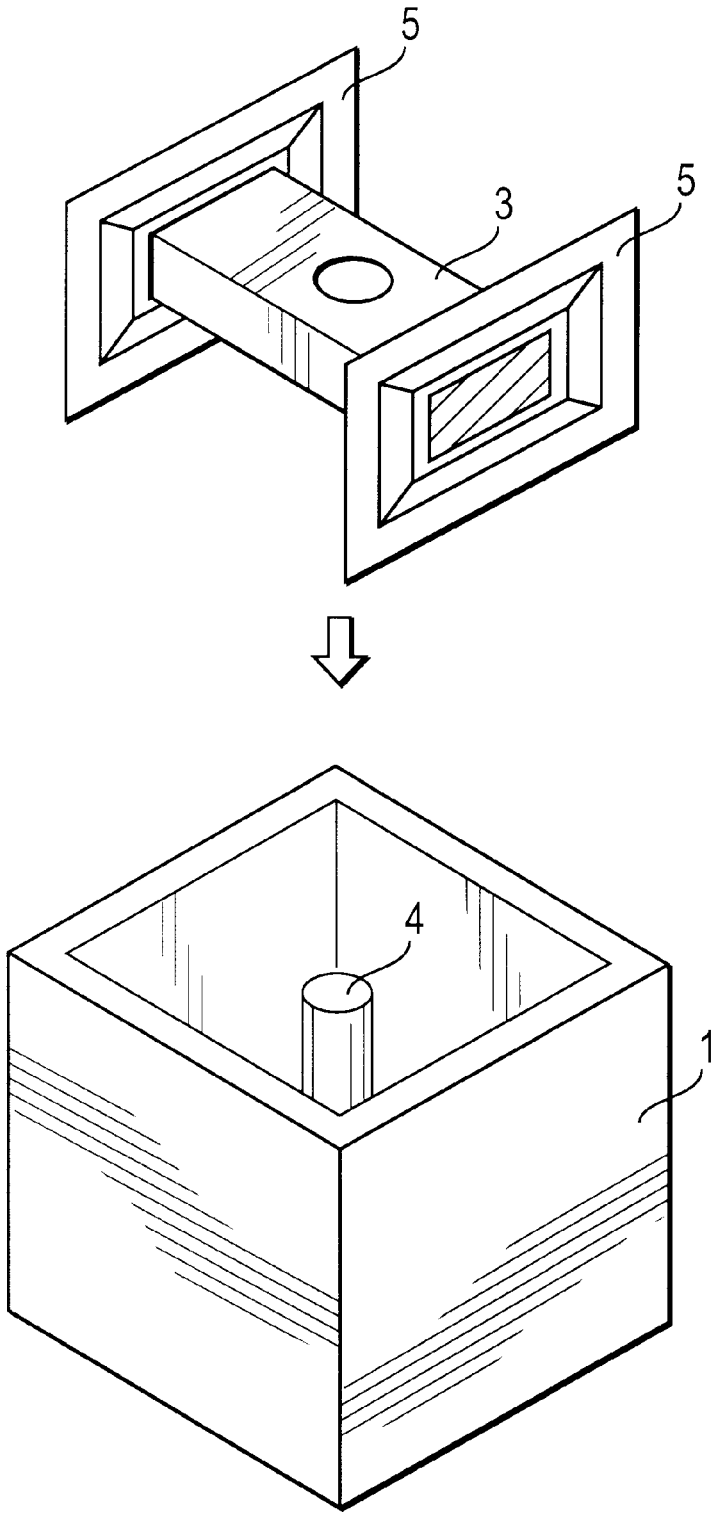
FIG. 2 is an exploded perspective view of the dielectric resonator.
Figure 3:
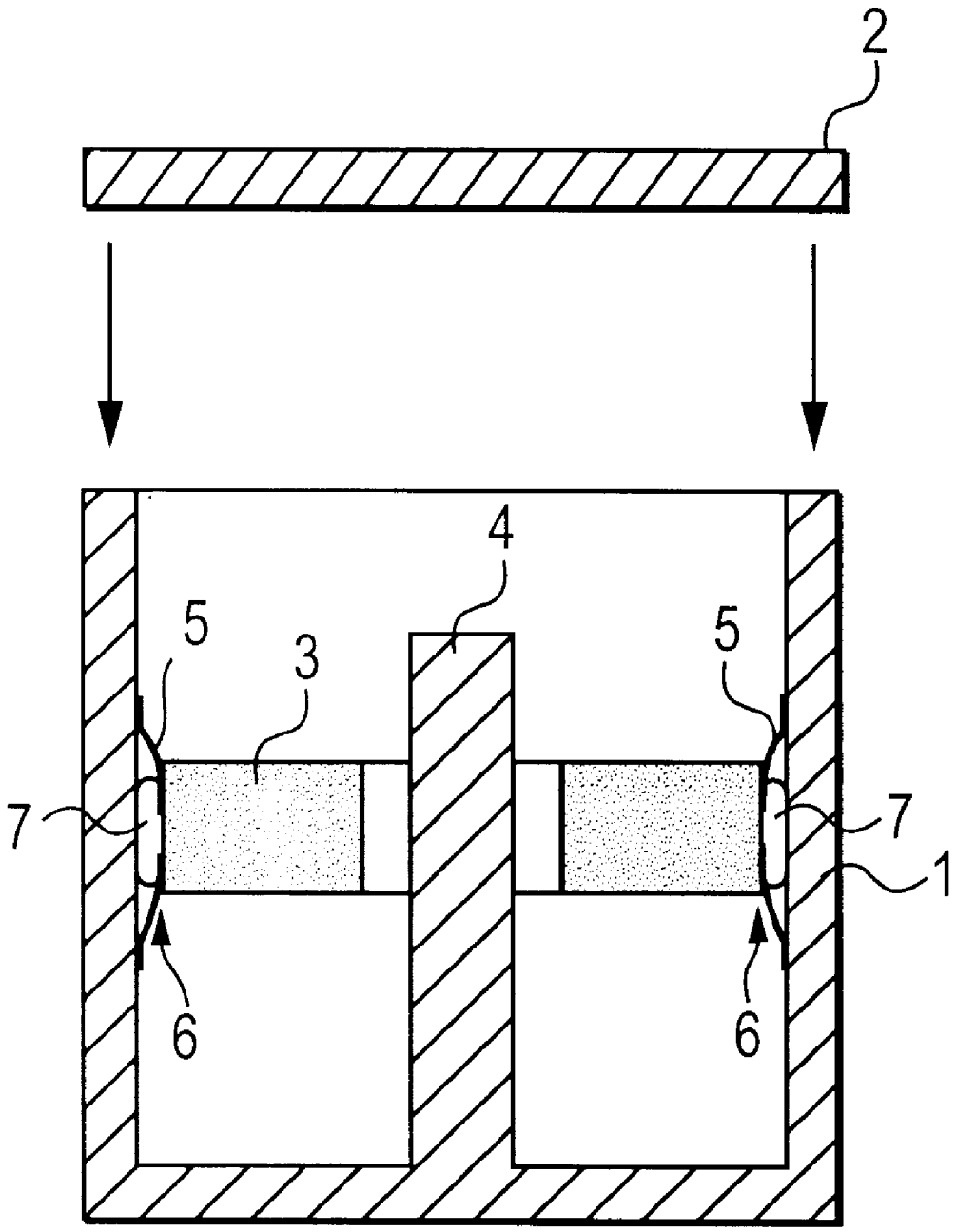
FIG. 3 is a cross-sectional view of the dielectric resonator.

FIG. 2 is a perspective view illustrating a manner in which the dielectric core is combined with the cavity member, and FIG. 3 is a cross-sectional view thereof. As shown in FIG. 3, the raised parts of metal foils 5 are joined (for example, soldered) to the respective end faces of the dielectric core 3. The dielectric core 3 is placed into the cavity as follows. First, as shown in FIG. 2, the dielectric core 3 with the metal foils soldered to both end faces is inserted into the main portion 1 of the cavity member such that a conducting bar 4 is inserted into the hole formed in the dielectric core. When the dielectric core comes to a predetermined height, the peripheral parts of the metal foils 5 are joined (for example, soldered) to the inner surface of the main portion 1 of the cavity member. Furthermore, an adhesive 7 is placed in the recessed portion (inner surface) of each metal foil 5 before the dielectric core is inserted in the main portion 1 of the cavity member, and the adhesive 7 is cured by applying heat after the dielectric core is inserted in the main portion 1 of the cavity member, thereby connecting the inner surface of each metal foil 5 and each end face of the dielectric core 3 to the inner surface of the main portion 1 of the cavity member.

As for the adhesive, an electrically conductive adhesive such as an epoxy or silicone adhesive containing Ag or the like may be employed. In particular, an epoxy adhesive containing rubber is desirable to achieve high reliability. The electrically conductive adhesive has a high heat radiating capacity, and thus the heat resistance is improved.

Thereafter, the open end of the main portion 1 of the cavity member is closed with the cavity lid 2, as shown in FIG. 3, by means of soldering or using a screw so as to form a complete dielectric resonator.

In FIG. 3, the connecting by means of the adhesive 7 may be performed first, and then the peripheral part of each metal foil 5 may be soldered to the inner wall of the main portion 1 of the cavity member.

In the example shown in FIGS. 1 to 3, an opening is formed in the raised part of each metal foil 5 so that when the metal foil 5 is soldered to the end face of the dielectric core 3, the electrode on the end face of the dielectric core 3 is partially exposed thereby ensuring that the soldering can be easily performed in a highly reliable fashion. This also permits a direct connection by means of the adhesive 7 between each end face of the dielectric core 3 and the inner surface of the main portion 1 of the cavity member through the hole of each metal foil 5, which results in enhancement of the adhesive strength between them.

However, note that the opening in the metal foil 5 is not necessarily needed. When the metal foil 5 has no opening, the metal foil 5 can also be soldered to the end face of the dielectric core, and the recessed side (inner surface) of the metal foil 5 can be bonded to the inner surface of the wall of the main portion 1 of the cavity member so that the dielectric core 3 is adhesively fixed via the metal foil 5 to the inner surface of the main portion 1 of the cavity.

Furthermore, the adhesive 7 is not necessarily needed. When the adhesive 7 is not used, the thickness of the metal foil 5 may be increased so as to have proper rigidity. Because the metal foil 5 has a dish-like shape whose central part is raised such that the raised part and the peripheral part form respective planes, relatively high rigidity can be obtained as a whole although the foil has a small thickness. On the other hand, the metal foil 5 has a proper degree of elasticity which absorbs distortion due to the difference between the linear expansion coefficient of the dielectric core and that of the cavity member. This elasticity further absorbs a variation in the size of the dielectric core.

Figure 4A:
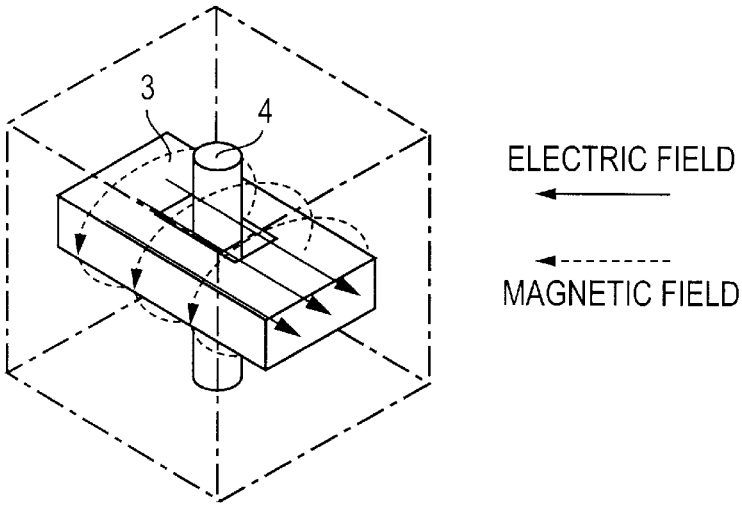
FIGS. 4A–4C are diagrams illustrating examples of electromagnetic field distributions in the dielectric resonator, for various resonance modes.
Figure 4B:
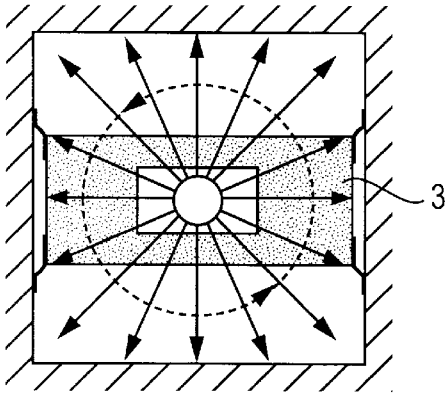
Figure 4C:
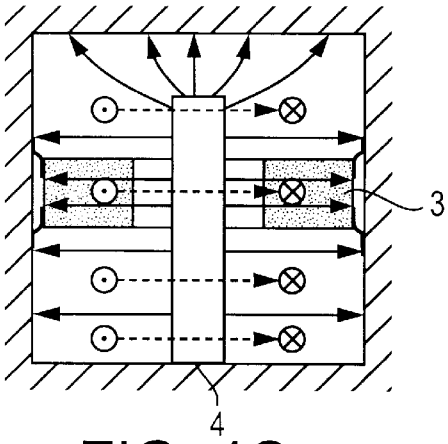

FIGS. 4A–4C illustrate examples of electromagnetic field distributions in various modes, wherein solid arrows represent electric field vectors and broken arrows represent magnetic field vectors. FIG. 4A illustrates a TM-mode electromagnetic field distribution in the dielectric core 3 and the cavity. In this mode, the electric field vector points in a direction parallel to the longitudinal direction of the dielectric core 3, and the magnetic field vector forms a loop in a plane perpendicular to the longitudinal direction of the dielectric core 3. Although the dielectric core has the rectangular shape, a circular cylindrical coordinate system is employed herein to describe the mode, wherein h is taken along the propagation direction, θ is taken to represent the angle in a plane perpendicular to the propagation direction, and r is taken in a radial direction in the plane perpendicular to the propagation direction. If the numbers of waves in the respective directions in the electric field distribution are represented by TMθrh, the present mode can be represented as a TM010 mode. Note that although this mode is similar to the strict TM010 mode, there is a slight difference because the dielectric core is not cylindrical and the conducting bar 4 is formed in the center of the dielectric core 3. Thus, this mode is herein referred to as a quasi-TM mode.

FIG. 4B is a top view illustrating a semi-coaxial resonator mode formed by the cavity member and the conducting bar, and FIG. 4C is a front view thereof. In this mode, the electric field vector points from the conducting bar to the inner walls of the cavity member, and the magnetic field vector forms a loop along the conductive bar. In this semi-coaxial resonator, unlike ordinal semi-coaxial resonators, the dielectric core 3 is provided, and a gap is formed between the top of the conducting bar 4 and the top wall of the cavity member. Therefore, this mode is herein referred to as a quasi-TEM mode.

Figure 5:
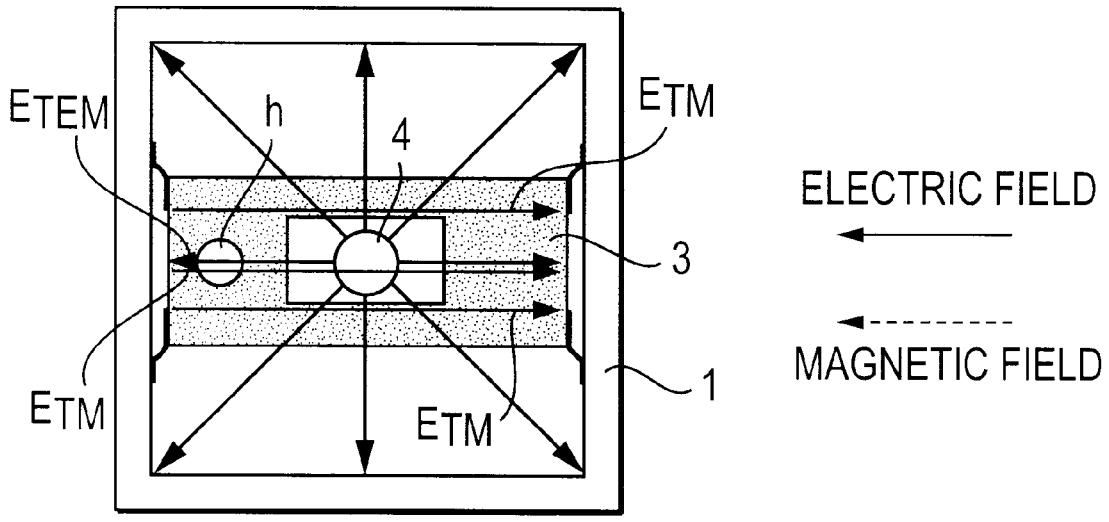
FIG. 5 is a diagram illustrating coupling between two resonance modes in the dielectric resonator.

FIG. 5 illustrates an example of a structure which can be used to couple the above-described two modes with each other. Note that FIG. 5 is a top view of the structure and the cavity lid is not shown. In FIG. 5, the electric field vector $E_{TEM}$ in the quasi-TEM mode points in a radial direction from the conducting bar 4 and the electric field vector $E_{TM}$ in the quasi-TM mode points in the longitudinal direction of the dielectric core 3. Therefore, these two modes can be coupled with each other by disturbing the balance between the electric field strength in the region extending along the longitudinal direction of the dielectric core from one end of the dielectric core 3 and the center (at which the conductive bar 4 is disposed) and that in the region from the center to the other end of the dielectric core 3. To this end, a coupling adjustment hole h is formed as shown in FIG. 5 so as to disturb symmetry of the electric field strength in the vicinity of the coupling adjustment hole thereby coupling the quasi-TEM mode and the quasi TM-mode with each other. The degree of coupling is determined by the size (the inner diameter or the depth) of the coupling adjusting hole.

A dielectric resonator is formed using the quasi-TM mode and the quasi-TEM mode in the above-described fashion.

Figure 6A:
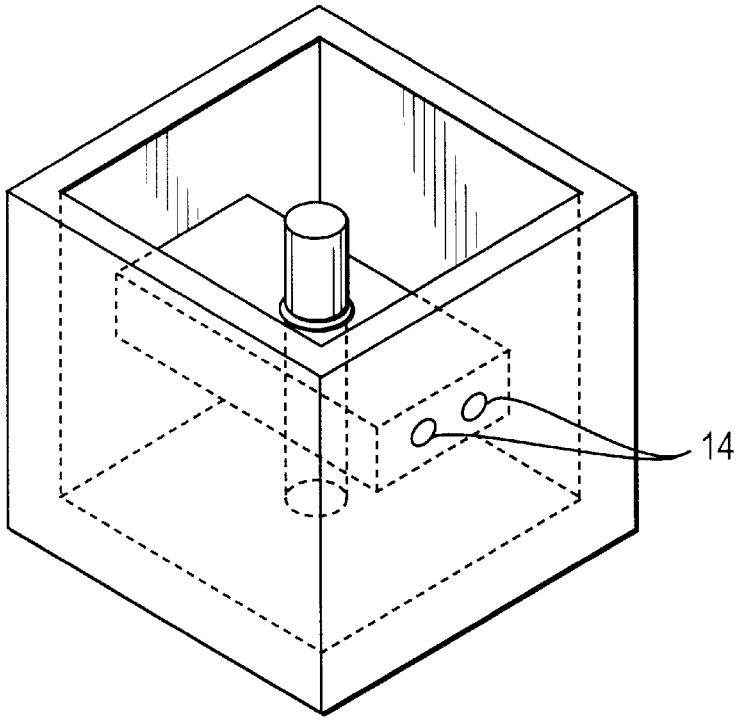
FIGS. 6A–6B illustrate, in the form of a perspective view and a cross-sectional view, a dielectric resonator according to a second embodiment of the present invention.
Figure 6B:
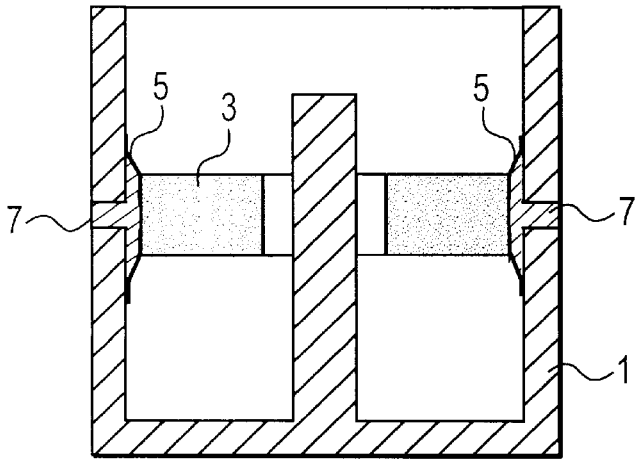

The structure of a dielectric resonator according to a second embodiment is described below with reference to FIGS. 6A–6B. FIG. 6A is a perspective view of the dielectric resonator wherein its cavity lid is removed, and FIG. 6B is a cross-sectional view thereof. In this second embodiment, unlike the dielectric resonator according to the first embodiment described above with reference to FIGS. 2 and 3, a main portion 1 of the cavity member has holes 14 communicating with spaces enclosed by the inner surface of the raised portion of the respective metal foils 5 and the inner surface of the main portion 1 of the cavity member, that is, communicating with the inside of the raised portion of the respective metal foil 5.

This dielectric resonator is assembled as follows. First, the dielectric core 3 with the metal foils 5 soldered to both end faces is inserted into the main portion 1 of the cavity member, and the dielectric core 3 is temporarily fixed at a predetermined height. While maintaining the dielectric core 3 at that height, the peripheral portions of the respective metal foils 5 are soldered to the inner surface of the main portion 1 of the cavity member. Thereafter, an adhesive 7 is injected from the outside of the main portion 1 of the cavity member 1 into the spaces via the holes 14, and the adhesive is cured. In this process, the inside of each hole 14 is filled with the adhesive 7.

In this structure, the cured adhesive 7 fits in each hole 14 and thus the bond strength between the dielectric core 3 and the main portion 1 of the cavity member is increased.

If a plurality of holes 14 for injecting the adhesive are formed for each space as shown in FIG. 6A, breathability is obtained and thus the adhesive can be very quickly injected into each space in a highly reliable fashion. The above-described spaces are not necessarily needed to be fully filled with the adhesive, and the spaces are allowed to partially remain unfilled. The purpose is that the cured adhesive serve to provide sufficient bond strength between the inner surface of the raised portion of the metal foil 5 and the inner surface of the main portion 1 of the cavity member.

The structure of a dielectric resonator according to a third embodiment of the present invention is described below with reference to FIGS. 7A, 7B and 8.

FIGS. 7A and 7B illustrate, in the form of a perspective view, two examples of dielectric cores each having a recessed portion 11 formed on each end face of the dielectric core.

FIG. 8 is a cross-sectional view illustrating a state in which either one of the dielectric cores shown in FIG. 7 is installed in a cavity. This dielectric resonator is assembled as follows. First, metal foils 5 are soldered to both respective end faces of a dielectric core 3, and the resultant dielectric core 3 is inserted into a main portion 1 of a cavity member through its opening. The dielectric core 3 is temporarily fixed at a predetermined height. While maintaining the dielectric core 3 at that height, the peripheral portions of the respective metal foils 5 are soldered to the inner wall of the main portion 1 of the cavity member. Furthermore, an adhesive 7 is injected through holes formed in the main portion 1 of the cavity member thereby adhesively fixing the dielectric core 3 and the metal foils 5 to the main portion 1 of the cavity member. In this process, the inside of the recessed portion 11 formed on each end face of the dielectric core 3 is also filled with the adhesive 7 and thus the mechanical strength against displacement between the dielectric core 3 and the cured adhesive 7 is enhanced.

The structure of a dielectric resonator according to a fourth embodiment of the present invention is described below with reference to FIG. 9.

Figure 9:
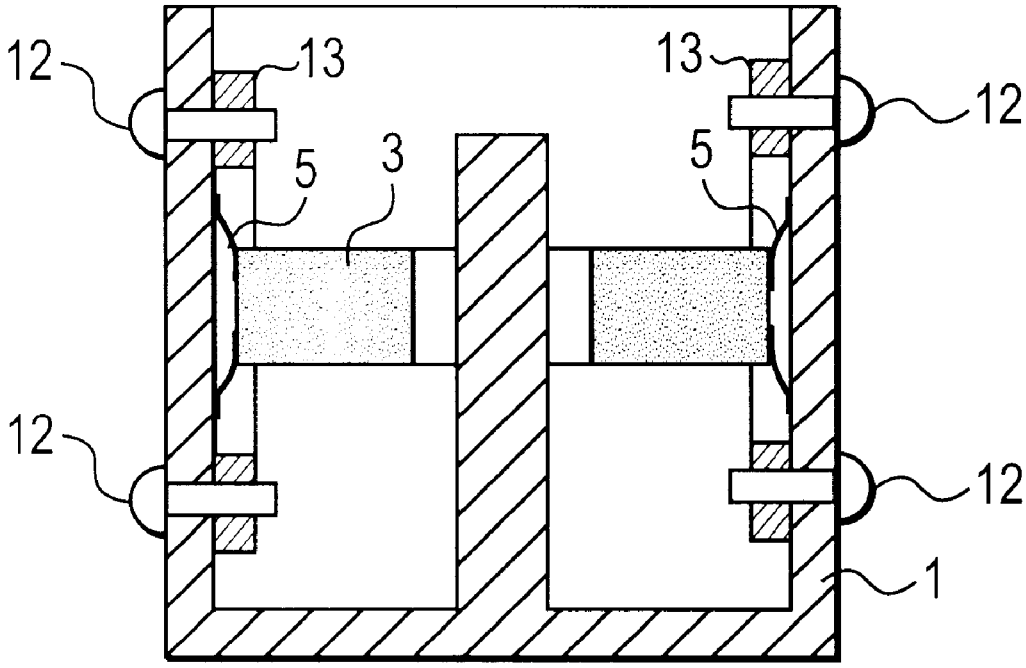
FIG. 9 is a cross-sectional view of a dielectric resonator according to a fourth embodiment of the present invention.

In this fourth embodiment, unlike the previous embodiments in which the peripheral portion of each metal foil 5 is soldered to the inner surface of the cavity member, the peripheral portion of each metal foil 5 is fixed to the main part 1 of the cavity member using screws 12 as shown in FIG. 9. That is, as shown in FIG. 9, a plurality of holes for passing screws therethrough are formed in advance in the peripheral portion of each metal foil 5 and also in the wall of the main portion 1 of the cavity member, and the two metal foils 5 are fixed to the wall of the main portion 1 of the cavity member using screws 12 and two respective fixing members 13 which may have a rectangular ring shape corresponding to the cross-sectional shape of the dielectric core 3.

This dielectric resonator is assembled as follows. First, the dielectric core 3 is inserted into two ring-shaped fixing members 13. Thereafter, the metal foils 5 are soldered to both respective end faces of the dielectric core 3. The resultant dielectric core 3 is placed into the main portion 1 of the cavity member, and the metal foils 5 are fixed with screws 12 inserted into the fixing members 13 from the outside.

Although in this and previous embodiments the metal foils are connected to end faces of the dielectric core by means of soldering, the connection may be achieved using an electrically conductive adhesive or other types of electrically conductive connecting material.

Although in this and previous embodiments, the dielectric core is formed in the shape of a rectangular parallelepiped, the dielectric core may also be formed in the shape of a polygonal or circular prism.

Figure 10A:
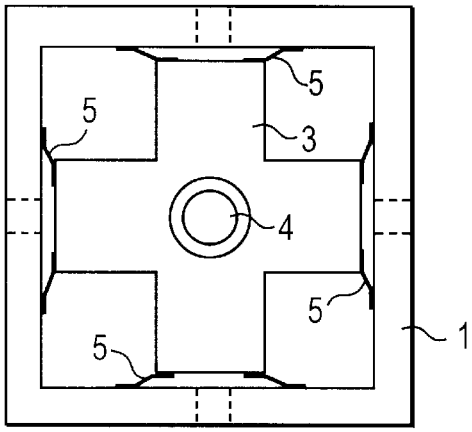
FIGS. 10A–10C are top views illustrating the structures of three dielectric resonators.
Figure 10B:
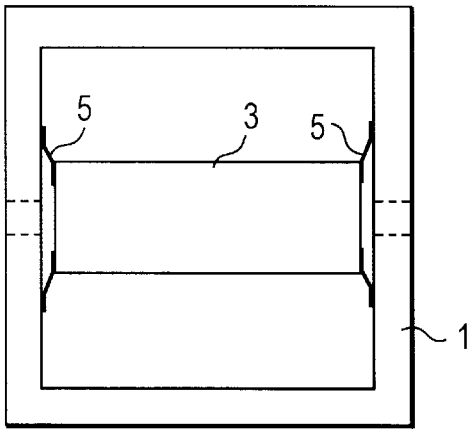
Figure 10C:
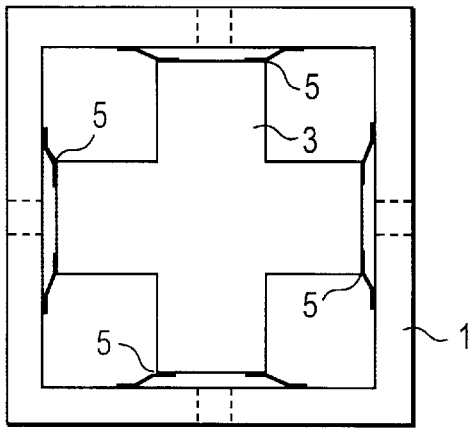

FIGS. 10A–10C illustrate three other examples of structures of the dielectric resonator, wherein the structures are shown in the form of a top view in which the cavity lid is not shown.

In the example shown in FIG. 10A, the dielectric core 3 comprises two crossed dielectric prisms, wherein an electrode film is formed on each of four end faces and a metal foil 5 is soldered to each end face. The electrical connection between the peripheral portion of each metal foil 5 and the inner surface of the main portion 1 of the cavity member and the mechanical connection of the dielectric core 3 and the metal foils 5 to the main portion 1 of the cavity member are achieved by one of the techniques described above with reference to FIGS. 1A to 9. The structure according to the present embodiment allows achievement of a dielectric resonator which uses two quasi-TM modes and one quasi-TEM mode.

In the example shown in FIG. 10B, a dielectric core 3 is simply installed in a main portion 1 of a cavity member without forming a conducting bar in the cavity and without forming a hole for passing the conductive bar through the dielectric core 3. With this structure, a dielectric resonator using a single TM mode can be achieved.

In the example shown in FIG. 10C, a cross-shaped dielectric core 3 is installed in a cavity without disposing a conducting bar in the cavity. With this structure, a dielectric resonator using two TM modes can be achieved.

The structure of a dielectric resonator according to a fifth embodiment of the present invention is described below with reference to FIGS. 11 to 14.

Figure 11:
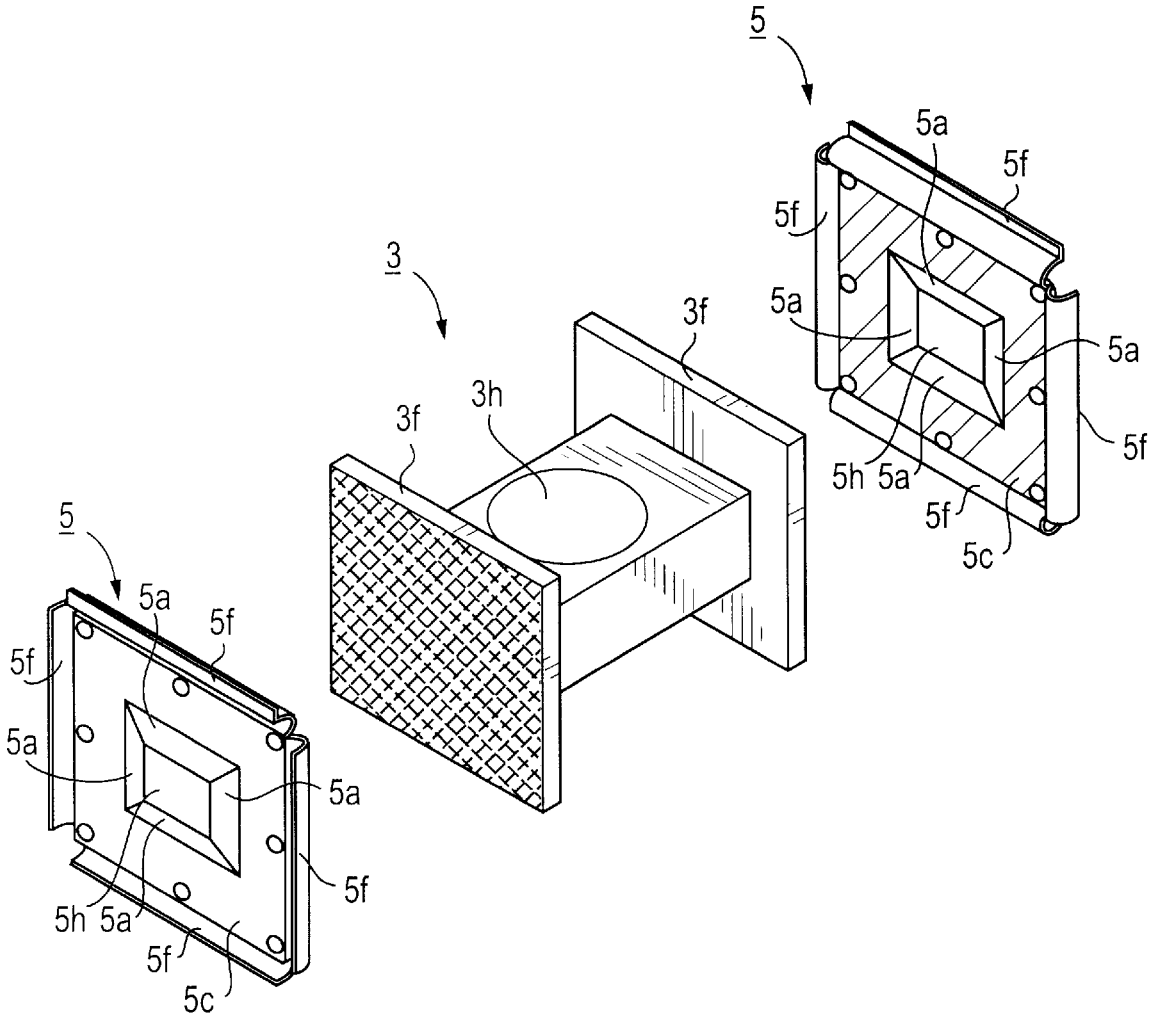
FIG. 11 is a perspective view illustrating a dielectric core and metal foils used in a dielectric resonator according to a fifth embodiment of the present invention.

FIG. 11 is a perspective view illustrating the shapes of a dielectric core and metal foils. The dielectric core 3 includes a rectangular parallelepiped portion having a circular hole 3*h* formed in the center thereof and flange portions 3*f* extending from both respective ends of the rectangular parallelepiped portion. This dielectric core may be produced by means of monolithic molding or by bonding the rectangular parallelepiped portion and the flange portions with each other. The end face of each flange portion 3*f* is covered with a Ag electrode film formed by means of coating and baking.

Each metal foil 5 includes a cover portion 5*c* for covering the end face of the corresponding flange portion of the dielectric core, a spring portion 5*f*, an opening 5*h*, and a raised portion 5*a*.

The spring portion 5*f* is formed by bending the metal foil 5 such that when the metal foil 5 is attached to the corresponding flange portion 3*f* with the end face of the flange portion 3*f* covered by the cover portion 5*c*, the outer edge of the flange portion 3*f* is covered by the spring portion 5*f*.

The raised portion 5*a* is formed by first partially cutting the cover portion 5*c* from the four respective comers of the opening 5*h* in diagonal directions thereby forming four flaps and then raising the resultant four flaps toward a side which will face the inner wall surface of the cavity.

Figure 12:
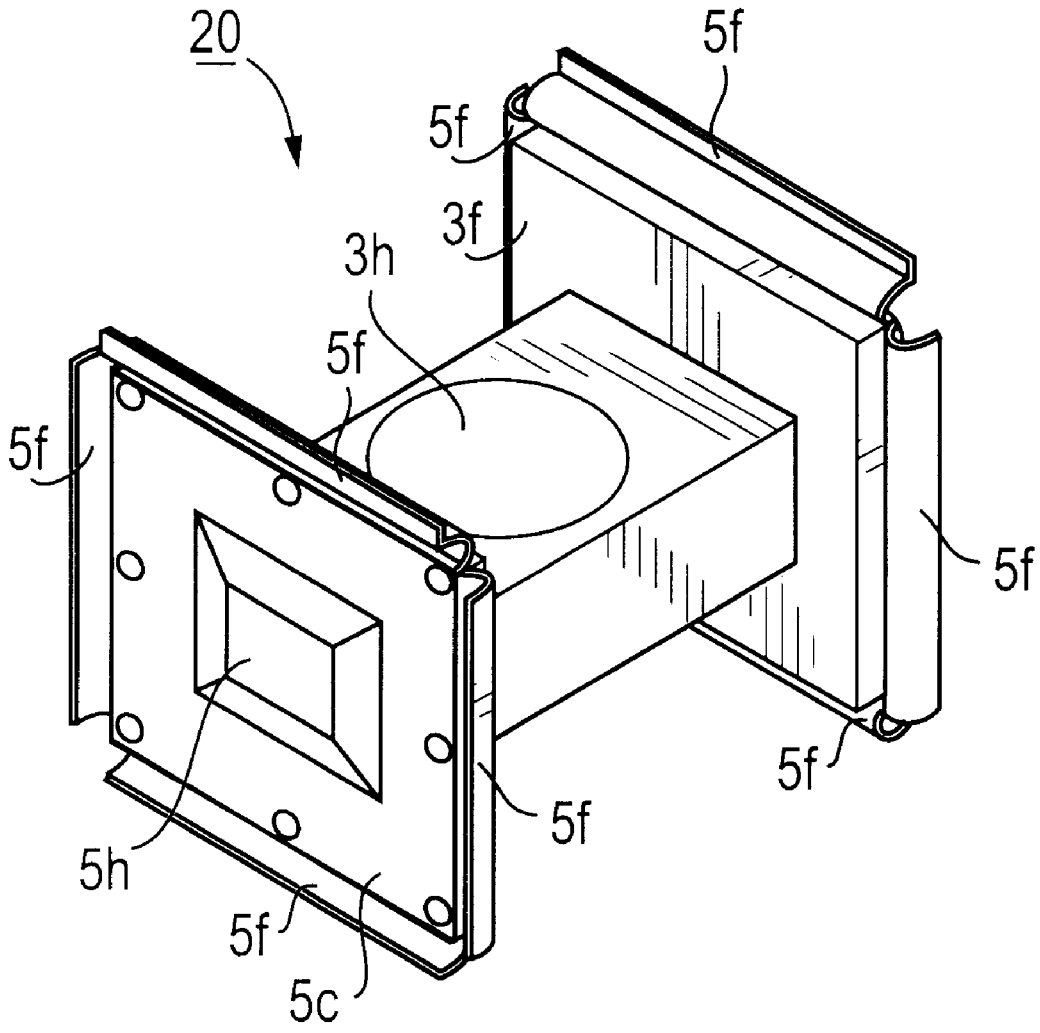
FIG. 12 is a perspective view of a dielectric core unit used in the dielectric resonator according to the fifth embodiment of the present invention.

FIG. 12 is a perspective view illustrating a dielectric core unit including the above-described dielectric core and metal foils.

This dielectric core unit is assembled by soldering the cover portions of the metal foils to the end faces of the two respective flange portions of the dielectric core. The soldering is performed by first coating solder paste on the end faces of the two flange portions of the dielectric core or on the cover portions of the metal foils or on both the end faces and the cover portions, and then heating the whole. Alternatively, the soldering may be performed using a soldering iron through eight holes formed in the peripheral region of the cover portion of each metal foil.

Figure 13:
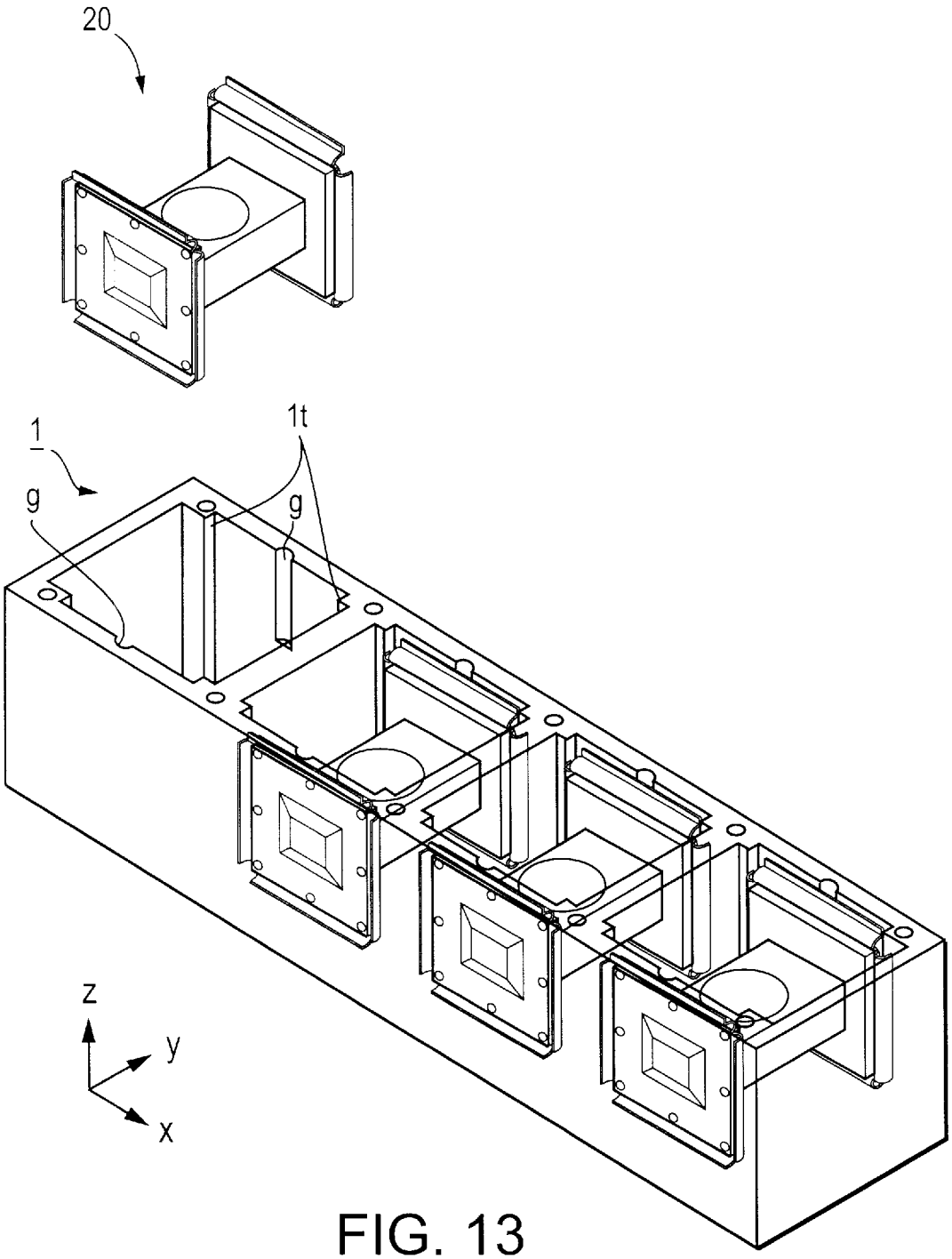
FIG. 13 is a perspective view illustrating dielectric core units and a cavity member used in the dielectric resonator according to the fifth embodiment of the present invention.
Figure 14:
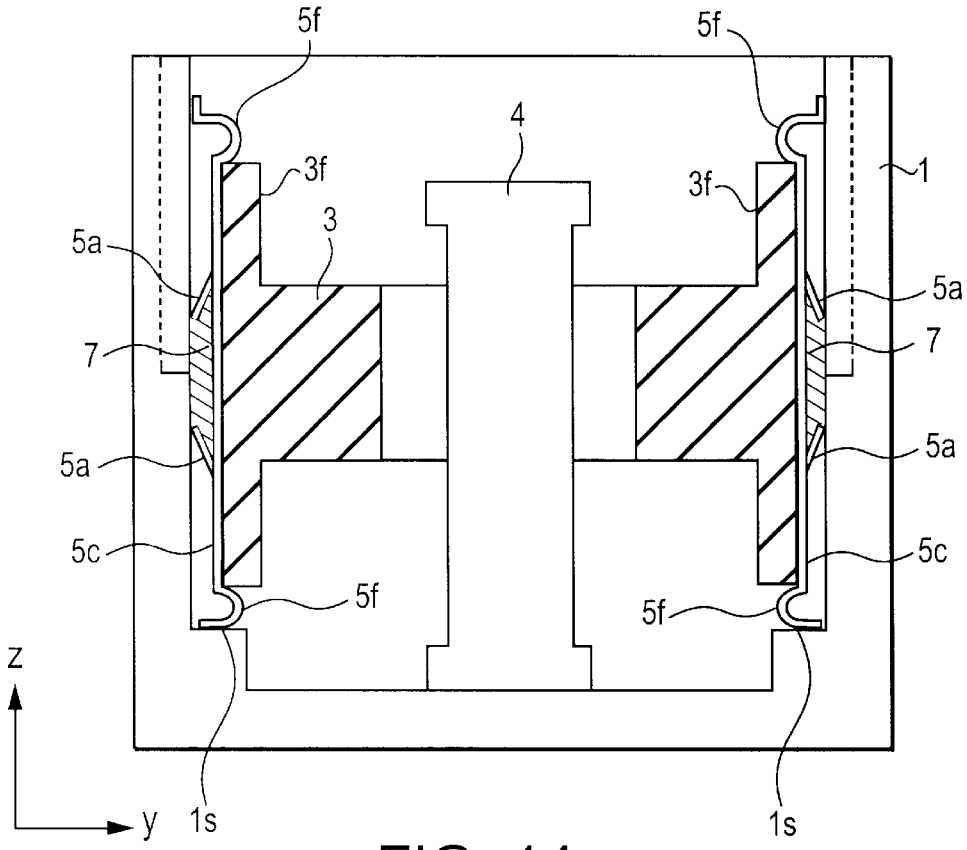
FIG. 14 is a diagram illustrating a manner in which a dielectric core unit is installed in a cavity of the dielectric resonator according to the fifth embodiment of the present invention.

FIG. 13 is a perspective view illustrating a manner in which dielectric units are mounted in a cavity member, and FIG. 14 is a cross-sectional view illustrating a main portion thereof. Note that the cavity lid covering the opening of the cavity is not shown in FIGS. 13 and 14.

The main portion 1 of the cavity member is formed of aluminum using a die casting technique. The inner and outer surfaces of the main portion 1 of the cavity member are covered with an Ag electrode film. In this specific example, the main portion 1 of the cavity member has four cavities in which four dielectric core units are installed. When the dielectric core units are fully inserted into the main portion of the cavity member, the spring portion on the lower edge of each metal foil comes into contact with a corresponding step portion 1*s* formed on the bottom surface of each cavity thereby positioning each dielectric core unit in a z direction (in a direction in which each dielectric core is inserted) as shown in FIG. 14. Furthermore, as shown in FIG. 13, the spring portions on the right and left sides of each metal foil come into contact with step portions 1*t* extending in the z direction on the inner surface of the cavity wall thereby positioning each dielectric core in an x direction (in a direction in which the plurality of dielectric core units are arranged). Furthermore, as shown in FIG. 14, the spring portions 5*f* and the raised portions 5*a* of the two respective metal foils come into contact with the inner surfaces of the opposite cavity walls thereby positioning each dielectric core unit in a y direction (in the longitudinal direction of the dielectric core). As a result, the spring portions of the metal foils support each dielectric unit core 20 in the corresponding cavity, in the x, y and z directions. Thus, each dielectric core is fixed in the corresponding cavity in a floating fashion.

The dielectric core units are mounted into the main portion of the cavity member as follows. First, for dielectric core units in the state shown in FIG. 12, solder paste is coated on a predetermined surface (surface to be soldered) of the spring portion of each metal foil or in predetermined areas (areas to be soldered) of the inner surface of the cavity walls or on both the predetermined surface of the spring portion and the predetermined areas of the inner surface of the cavity walls. Thereafter, as shown in FIG. 13, the four dielectric core units are inserted into the corresponding cavities, and the whole is heated thereby performing soldering. After completion of the soldering, an adhesive is injected through grooves g which are formed on the inner surface of the cavity walls as shown in FIG. 13. The lower end of each groove g is formed at a particular height so that when the dielectric core units are inserted in the corresponding cavities, the lower end of each groove g is at the opening of the corresponding metal foil. This allows the inside of the raised portion 5*a* to be filled with the adhesive. The adhesive is then cured. Each space surrounded by the raised portions 5*a* is not necessarily fully filled with the adhesive. It is sufficient if the adhesive is injected in the above-described spaces so that the dielectric core units and the metal foils are connected strongly enough for an intended purpose to the inner surface of the cavity walls.

The structure described above makes it possible to electrically and mechanically support each dielectric core unit in the corresponding cavity. Furthermore, because the flange portions of the dielectric core units 3 are elastically supported inside the cavity member via the spring portions and the cured adhesive, thermal stress between each dielectric core unit and the cavity member is reduced. Furthermore, the size difference between each dielectric core unit and the cavity is absorbed by the spring portions, and thus no excessive stress occurs in the bonding portions. Still furthermore, if the flange size of the dielectric core is fixed, the metal foils and the cavity member can be standardized. This makes it possible to form dielectric resonators having various different characteristics using the same metal foils and the same cavity member simply by modifying the size of the dielectric core other than the flange portions depending upon the required characteristic.

In the example shown in FIG. 14, the conducting bar 4 disposed in the cavity allows the dielectric resonator to operate in the quasi-TEM mode as described earlier with reference to the first embodiment. Furthermore, the combination of the dielectric core 3 and the cavity member 1 allows the resonator to operate in the quasi-TM mode.

The diameter of the top portion of the conducting bar 4 is increased so as to increase the area facing the cavity lid thereby increasing the capacitance between the conducting bar 4 and the cavity lid. A high current is concentrated in the bottom portion of the conductive bar 4. To avoid problems due to the current concentration, the diameter of the bottom portion of the conducting bar 4 is also increased. This results in a reduction in loss. The diameter of the portion other than the top and bottom portions of the conducting bar 4 is determined so as to obtain an optimized characteristic depending upon the internal size of the cavity. Thus, the total size and the loss are minimized. The top portion of the conductive bar 4 may be formed to be rounded so that the concentration of the electric field in the top portion of the conducting bar is reduced and the maximum allowable power is increased.

In the example shown in FIG. 13, eight resonators are formed using four dielectric core units. A filter including a plurality of resonator stages can be obtained by coupling adjacent resonators with each other from one set of adjacent resonators to another. A suitable manner of coupling adjacent resonators with each other is well known and therefore is not described in detail herein.

In the example described above with reference to FIGS. 11 to 14, the dielectric core unit has flange portions. Alternatively, the metal foils described above with reference to FIGS. 11 to 14 may be applied to a dielectric resonator including a dielectric core having the shape of a simple prism or a circular cylinder and having no flange portions. In this case, each end face of a dielectric core may be connected to the center of a metal foil 5 such as that shown in FIG. 11. Alternatively, the metal foil may be formed to have a size corresponding to the size of the end face of the dielectric core. More specifically, in this case, the spring portion of the metal foil may be formed by bending the metal foil along the edge of the bonding face at the end face of the dielectric core so that the metal foil is bent along the outer edge of the end face of the dielectric core.

Figure 15:
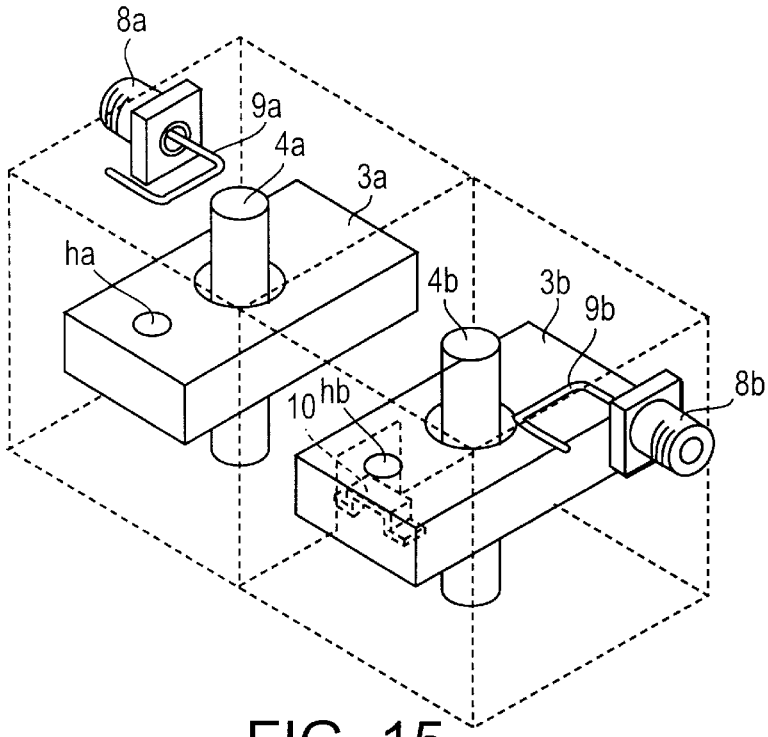
FIG. 15 is a diagram illustrating an example of a configuration of a filter.

An example of the structure of a filter is described below with reference to FIG. 15. In FIG. 15, cavities are represented by alternate long and two short dashed lines. The top end of each conducting bar 4*a*, 4*b* is spaced from the inner surface of the cavity wall. In this structure, the combination of the conducting bar 4*a* and the cavity around it serves as a resonator in the quasi-TEM mode, and the combination of the dielectric core 3*a* and the cavity around it serves as a resonator in the quasi-TM mode. Similarly, the combination of the conducting bar 4*b* and the cavity around it serves as a resonator in the quasi-TEM mode, and the combination of the dielectric core 3*b* and the cavity around it serves as a resonator in the quasi-TM mode. The central conductor of each coaxial connector 8*a*, 8*b* is coupled with the inside of the corresponding cavity via a coupling loop 9*a* or 9*b*. The coupling loops 9*a* and 9*b* are disposed such that these loops 9*a* and 9*b* have linkage with magnetic flux in the TM modes described above but have substantially no linkage with magnetic flux in the TEM modes. Thus, the loops 9*a* and 9*b* are magnetically coupled with the TM modes described above.

Coupling adjustment holes ha and hb similar to the coupling adjustment hole h shown in FIG. 5 are provided for coupling the quasi-TM mode and the quasi-TEM mode with each other. Furthermore, a window is formed in the wall between the adjacent cavities, and a coupling loop 10 is disposed such that it extends across the window. The coupling loop 10 is disposed such that the loop plane thereof orients in a direction which does not allow flux linkage in the quasi-TM mode but allows flux linkage in the quasi-TEM mode. Thus, the coupling loop 10 magnetically couples with the quasi-TEM modes in the two cavities. As a result, the following coupling occurs from the coaxial connector 8a toward the coaxial connector 8*b*: quasi-TM mode→quasi-TEM mode→quasi-TEM mode→quasi-TM mode. As a whole, therefore, the filter behaves as a bandpass filter consisting of four resonator stages.

Figure 16:
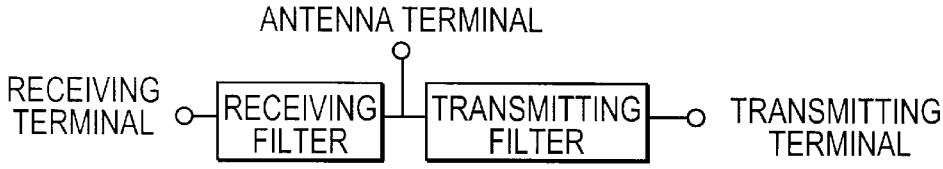
FIG. 16 is a block diagram illustrating a configuration of a duplexer.

FIG. 16 illustrates an example of a configuration of a duplexer. In the configuration shown in FIG. 16, a filter such as that described above with reference to FIG. 15 may be employed as a transmitting filter and as a receiving filter. The transmitting filter passes a transmission signal frequency and the receiving filter passes a reception signal frequency. The location of the node at which the output port of the transmitting filter and the input port of the receiving filter are connected to each other is selected such that the electrical length from the node to the effective short-circuited plane of the final resonator stage of the transmitting filter becomes equal to an odd multiple of one-quarter of the wavelength of the reception signal frequency and such that the electrical length from the node to the effective short-circuited plane of the first resonator stage of the receiving filter becomes equal to an odd multiple of one-quarter of the wavelength of the transmission signal frequency, thereby ensuring that the transmission signal and the reception signal are isolated from each other.

In a similar manner, a duplexer or a multiplexer can be formed by disposing a plurality of dielectric filters between a common port and individual ports.

Figure 17:
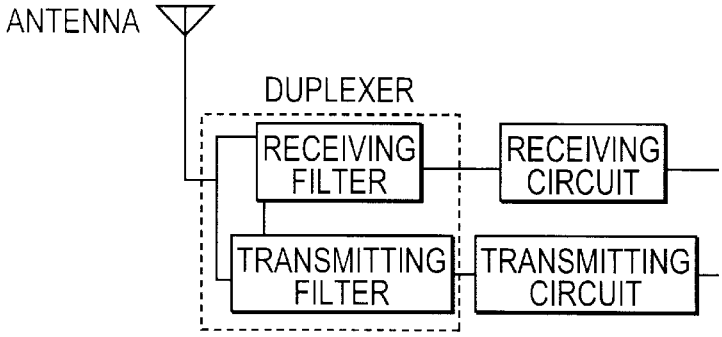
FIG. 17 is a block diagram illustrating a configuration of a communication device.
Figure 18:
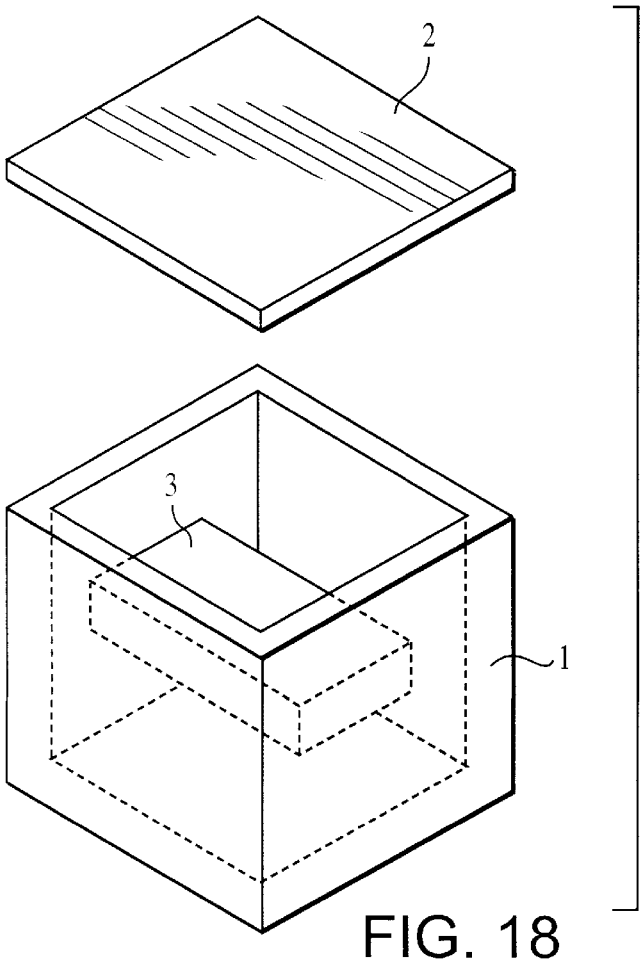
FIG. 18 PRIOR ART
FIG. 18 is a perspective view illustrating the structure of a conventional dielectric resonator.
Figure 19A:
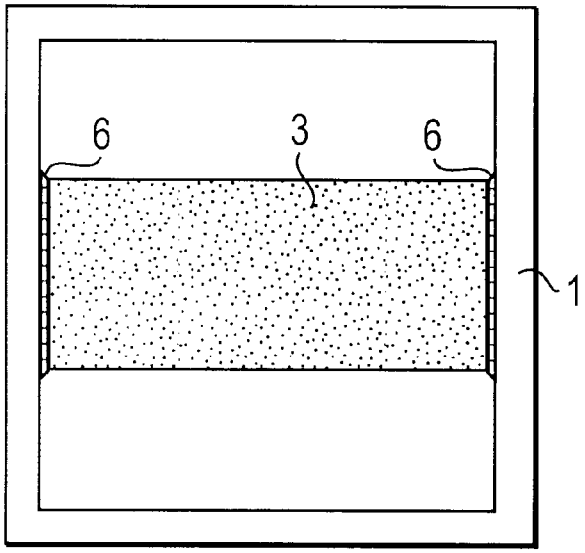
FIG. 19A PRIOR ART
FIGS. 19A and 19B illustrate, in the form of a top view and a cross-sectional view, the conventional dielectric resonator.
Figure 19B:
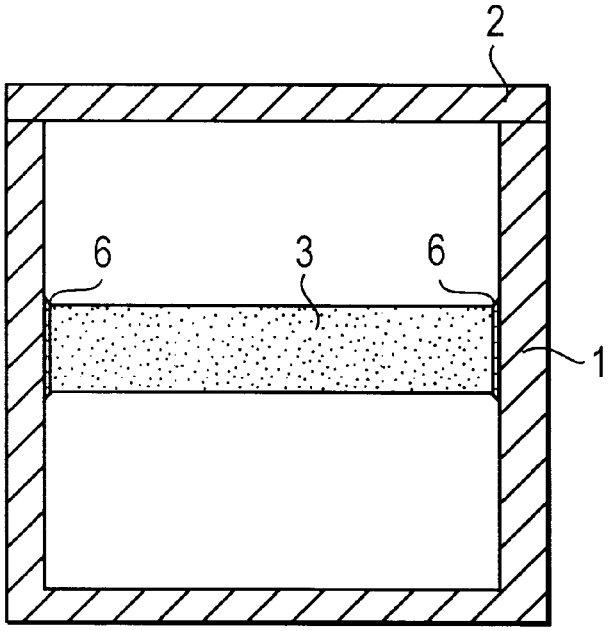
FIG. 19B PRIOR ART

FIG. 17 illustrates an example of a configuration of a communication device using the above-described duplexer. As shown in FIG. 17, a high-frequency part is formed by connecting the input port of the transmitting filter to a transmitting circuit, the output port of the receiving filter to a receiving circuit, and the input/output port of the duplexer to an antenna.

Furthermore, circuit elements such as a duplexer, multiplexer, coupler, and power divider may be formed using the dielectric resonator described above, and a small-sized communication device may be realized using such circuit elements.

As can be understood from the above description, the present invention has great advantages. That is, because the end face of the dielectric core is elastically connected to the inner surface of the cavity wall via the electrically conductive foil without being directly connected thereto, distortion due to the difference between the linear expansion coefficient of the dielectric core and that of the cavity member is absorbed by the foil, and thus no heat cycle fatigue occurs in the bonding portion between the dielectric core and the cavity member. As a result, improvements in the stability of the characteristics and in the reliability are achieved.

Furthermore, in the dielectric resonator according to the present invention, the dielectric core has a flange portion formed on an end thereof, and the electrically conductive foil has a cover portion for covering an end face of the flange portion, and the spring portion of the electrically conductive foil is formed by bending the cover portion along the edge of the flange portion. As a result, the dielectric core and the metal foil are connected to the inner surface of the cavity wall via the electrically conductive connecting material over a wide area apart from the center of the end face of the dielectric core. The electrically conductive connecting material such as solder or an electrically conductive adhesive generates noise when a current is passed therethrough. However, because the connection is made at a location far from the center of the dielectric core, and because the current density of the bonding portion becomes low, the noise generated by the dielectric resonator becomes low.

Furthermore, in the dielectric resonator according to the present invention, when the adhesive is inserted into the space surrounded by the raised portion, the electrical connection between the end face of the dielectric core and the cavity member is provided via the electrically conductive foil, and the mechanical connection is provided via both the foil and the adhesive. As a result, more reliable electrical and mechanical connections, and more stable characteristics, are achieved. Because the end face electrode of the dielectric core and the cavity member are electrically connected to each other via the electrically conductive foil, no electric field enters the adhesive, and thus no degradation occurs.

Furthermore, in the dielectric resonator according to the present invention, because the cavity member has the hole communicating with the space surrounded by the raised portion of the respective metal foil, it become easy to inject the adhesive from the outside of the cavity member. Furthermore, the cured adhesive is fitted in the hole and thus the bonding strength between the cavity member and the foil and the dielectric core is enhanced.

Still furthermore, in the dielectric resonator according to the present invention, because the dielectric core has the recessed and protruded portion formed on the end face thereof, the bonding strength between the end face of the dielectric core and the adhesive in a shearing direction is increased. This ensures that the positional deviation between the electric core and the cavity member is prevented, and thus the reliability is further enhanced.

The present invention also provides the high-reliability high-stability communication device using the filter or the duplexer.

Although the present invention has been described in relation to particular embodiments thereof, many other variations and modifications and other uses will become apparent to those skilled in the art. Therefore, the present invention is not limited by the specific disclosure herein.

What is claimed is:

1. A dielectric resonator comprising:

a dielectric core having an electrode formed on an end face thereof;

an electrically conductive cavity member; and an electrically conductive foil having a bonding surface bonded to said end face and also having a bent spring portion, the bonding surface of said foil being bonded to the end face of said dielectric core, the spring portion of said foil being bonded to the inner surface of said cavity member.

2. A dielectric resonator according to claim 1, wherein said dielectric core includes a flange portion formed on an end thereof, and wherein said electrically conductive foil includes a cover portion for covering an end face of said flange portion, and said spring portion of said electrically conductive foil includes a portion of said cover portion which is bent along an outer edge of said flange portion.

3. A dielectric resonator according to claim 1 or claim 2, wherein said conductive foil has an opening and a raised portion formed by partially raising said elastically conductive foil around said opening toward the inner surface of the cavity member, and an adhesive is disposed in a space surrounded by said raised portion.

4. A dielectric resonator according to claim 3, wherein said end face of said dielectric core has a recess which communicates with said space surrounded by said raised portion and said adhesive is disposed in said recess.

5. A dielectric resonator comprising:

a dielectric core having an electrode formed on an end face thereof;

an electrically conductive cavity member; and an electrically conductive foil, a central portion of which is raised to one side, said raised portion of said foil being bonded to the end face of said dielectric core; and a peripheral portion of said foil being bonded to the inner surface of said cavity member.

6. A dielectric resonator according to claim 5, wherein an adhesive is disposed in a space surrounded by said raised portion.

7. A filter including a dielectric resonator according to one of claim 1 and claim 5; and further comprising input/output terminals electromagnetically coupled to said dielectric resonator.

8. A communication device including filter according to claim 7 and further comprising at least one of a transmitting circuit and a receiving circuit connected to said filter.

9. A duplexer including a pair of filters according to claim 7 each said filter having a pair of said input/output terminals; a respective terminal of each of said filters being connected to a common antenna terminal; the other terminals of each of said filters being connected respectively to a transmitter input terminal and a receiver output terminal of said duplexer.

10. A communication device including a duplexer according to claim 9; and further comprising a transmitting circuit connected to said transmitter input terminal and a reception circuit connected to said receiver output terminal.

11. A dielectric resonator comprising:

a dielectric core having an electrode formed on an end face thereof;

an electrically conductive cavity member; and an electrically conductive foil, a central portion of which is raised to one side, said raised portion of said foil being bonded to the end face of said dielectric core;

a peripheral portion of said foil being bonded to the inner surface of said cavity member;

wherein an adhesive is disposed in a space surrounded by said raised portion;

wherein said cavity member has a hole leading to the space surrounded by said raised portion, and the hole and the space surrounded by said raised portion are filled with an adhesive.

12. A dielectric resonator according to claim 6 or claim 11, wherein said dielectric core has a recessed portion formed on an end face thereof.

* * * * *